United States Patent [19]

Claussen

[11] 4,359,097

[45] Nov. 16, 1982

[54] SPRINKLER SYSTEM

[75] Inventor: Lennart Claussen, Karlskoga, Sweden

[73] Assignee: Aktiebolaget Bofors, Bofors, Sweden

[21] Appl. No.: 155,815

[22] Filed: Jun. 2, 1980

[30] Foreign Application Priority Data

Jun. 13, 1979 [SE] Sweden ..... 7905190

[51] Int. Cl.[3] ..... A62C 37/18

[52] U.S. Cl. ..... 169/61; 169/16; 169/19; 137/487

[58] Field of Search ..... 169/16, 56, 58, 60, 169/61, 37, 57, 5, 19, 20, 26, 41; 340/289, 501, 590, 593, 500; 137/487.5, 487, 113; 62/259.2; 239/66, 67, 68

[56] References Cited

U.S. PATENT DOCUMENTS

| | | | |
|---|---|---|---|
| 2,799,781 | 7/1957 | Joyce et al. | 169/61 |
| 3,227,219 | 1/1966 | Boyer et al. | 169/5 |
| 3,685,588 | 8/1972 | Livingston | 169/16 |
| 3,811,511 | 5/1974 | McCulloch | 169/41 |
| 3,865,192 | 2/1975 | Dunphy | 169/19 |
| 3,917,001 | 11/1975 | Davis et al. | 169/61 |
| 4,013,128 | 3/1977 | Davis | 169/61 |
| 4,023,164 | 5/1977 | Delaney | 169/5 |
| 4,027,302 | 5/1977 | Healey et al. | 169/61 |
| 4,033,740 | 7/1977 | Meckler | 169/19 |
| 4,101,887 | 7/1978 | Osborne | 169/61 |

*Primary Examiner*—F. J. Bartuska
*Assistant Examiner*—Kenneth Noland
*Attorney, Agent, or Firm*—Pollock, Vande Sande & Priddy

[57] ABSTRACT

The present invention relates to a method of and a device for automatically releasing all or a predetermined number of sprinker heads comprised in a fire protection circuit when one of the heads (11) has been released by a local fire or a rise in temperature in the immediate vicinity of this particular head. The invention is based upon a flow detector arranged in the trunk pipe for the fire extinguishing fluid which when said fluid begins to flow through the trunk pipe, i.e. when at least one sprinkler head has opened, closes an electric ignition circuct (17–21, 25–27) which connects pyrotechnical activators arranged at the respective sprinkler heads with an electric ignition function controller (12), whereby the blocking devices at the outlets of the other sprinkler heads are blown away.

10 Claims, 2 Drawing Figures

SPRINKLER SYSTEM

TECHNICAL FIELD

The present invention relates to a method of and a device for ensuring that all the sprinkler heads connected in a fire protection circuit are activated when one of the heads is activated, e.g. by a small local fire in the immediate vicinity of this head.

BACKGROUND ART

There are sprinkler systems of various main types available for protection against fire. In a first type, a central detector releases a main valve which in turn distributes fire extinguishing fluid, generally water, to a number of sprinkler outlets. As the water in the rest position is not all the way up to the outlets, it can take quite a few seconds for the water to reach the place where the fire has started after the detector has activated the system.

This type of sprinkler is therefore unsuitable in premises where a fire can be expected to spread very rapidly. The advantages of a system of this type are that all of the heads are activated at one and the same time, and that it is relatively cheaper than other systems, as only one valve and one detector are required.

In another main type, the water, or the fire extinguishing fluid used, is already all the way up to the sprinkler heads in the waiting position, and the sprinkler heads can then be equipped with blocking means of their own, which are also activated individually. A system of this type will be very rapid, but requires a more complete activation system or a separate activator for each sprinkler head.

The releasing system hitherto most commonly used for separate sprinkler heads is based upon the use of special glass bulbs which contain a highly temperature sensitive fluid which at a predetermined temperature above the normal temperature causes the bulb to burst. By utilizing such a bulb as a blocking component in a sealing system arranged at the respective sprinkler head, a temperature sensitive individual releasing system with a high degree of functioning reliability is obtained. If the temperature exceeds the predetermined value, the bulb is thus crushed from the inside, and the blocking of the outlet of the sprinkler head is removed and the fire extinguishing fluid instantaneously begins to flow out. The drawback of this system in its more general form is that each sprinkler head must be activated individually. It can also be a drawback that most often only the sprinkler head or heads nearest the place where the fire starts are activated, and that this takes place only when the fire has developed sufficiently to produce a marked rise in temperature.

There is now a possibility of achieving simultaneous releasing of all the sprinkler heads comprised in the circuit if, for instance, these are provided with remote-controllable activators connected with an UV sensitive or other type of detector which reacts in case of a fire. The most prominent advantage of a UV sensitive detector would be that it can be made to react instantaneously to the first naked flame that appears, although the detector is not therefore released by e.g. bright sunlight. Thus, the UV detector need not, as in the case of temperature or smoke sensitive detectors, wait until a predetermined limit value is exceeded. The UV detector is thus released at a considerably earlier stage of a fire than detectors of other types. Regardless of the actual advantages of the UV detector it is, of course, quite possible to arrange for simultaneous releasing of a plurality of sprinkler heads in accordance with what is described in the following without the aid of UV detectors but by means of a pressure, smoke, or heat sensitive detector. The most simple way of simultaneously releasing a number of sprinkler heads of the type where the water is all the way up to the heads which are located at a distance from each other is to provide each and every head with a pyrotechnical activator which when it is activated by an ignition function connected together with a detector, blows away the blocking system that blocks the outlet of the sprinkler head.

In the Swedish patent application No. 7713209-0, which corresponds to U.S. Pat. No. 4,281,718 issued to Claussen and Broberg and commonly assigned, an unusually practical activator is described which is intended to be used in the way described above. Its function is based upon a very small pyrotechnical charge which, when it is ignited electrically, throws a charge of powder consisting of e.g. a fine-grained metal powder against a bulb of the type described above, which is crushed at the same time as the charge of powder is broken up into separate grains of powder. The bulb, which thus has a blocking function at the seal at the outlet of the sprinkler head, being crushed, the seal at the outlet falls away, and the fire extinguishing fluid begins to flow out.

Such electrically ignited pyrotechnical activators can be connected to the ignition function, e.g. ignition generators or battery igniters, which are activated by an appropriate detector of the type indicated above.

The activator described briefly above, combined with a UV detector, thus gives a rapid and very reliable function when it is a question of naked fire. As the temperature sensitive bulb is comprised in the system, also temperature dependent releasing is obtained, but then only of the sprinkler heads which are subjected to the elevated temperature.

DISCLOSURE OF THE INVENTION

Now it can often be desirable, primarily in premises where fires can be expected to develop very rapidly, to have all or a predetermined number of sprinkler heads released simultaneously in the fire protection circuit in question at the very first indication of a fire.

The present invention now offers a method of and a device for automatically releasing all of the sprinkler heads connected together in a fire protection circuit as soon as one of the sprinkler heads has been released.

According to the invention, a flow indicator connected together with a microswitch is arranged in the main pipe to the trunk pipe which conveys fire extinguishing fluid to the fire protection circuit. The flow indicator is made in such a way that as soon as fluid begins to flow through the trunk pipe, which thus takes place as soon as one or several of the sprinkler heads has opened, it will close the microswitch, which closes ignition circuits which via an ignition function activates pyrotechnical activators at predetermined sprinkler heads in the fire protection circuit. This guarantees a release of the sprinkler heads in question as soon as one of these has been released. It is thus possible to determine sections of the extinguishing range (the area) in advance.

A sprinkler system comprising pyrotechnically actuated sprinkler heads of the type described in the U.S.

Pat. No. 4,281,718 and activated at elevated temperatures, a UV detector for instantaneous release of all of the detectors when there is a naked flame, the releasing system according to the invention for releasing a predetermined number of sprinkler heads if one of these is activated thermally and a manual releasing device, provides previously entirely unachieved reliability.

In order to ensure that the extinguishing function will not be lost, for example, due to a decrease in the water pressure in the supply pipes or the like, a pressure detector can be arranged in the risers or other main pipes of the system, and this can be connected with a switch which closes if the pressure in the these pipes falls below a predetermined value. The switch is then connected so that when it closes it will break the ignition circuit and at the same time activate an acoustic or optical alarm.

BRIEF DESCRIPTION OF THE DRAWING

The invention has been defined in the following claims, and will now be described in more detail with reference to the accompanying figures, in which

BEST MODE FOR CARRYING OUT THE INVENTION

Figure 1:
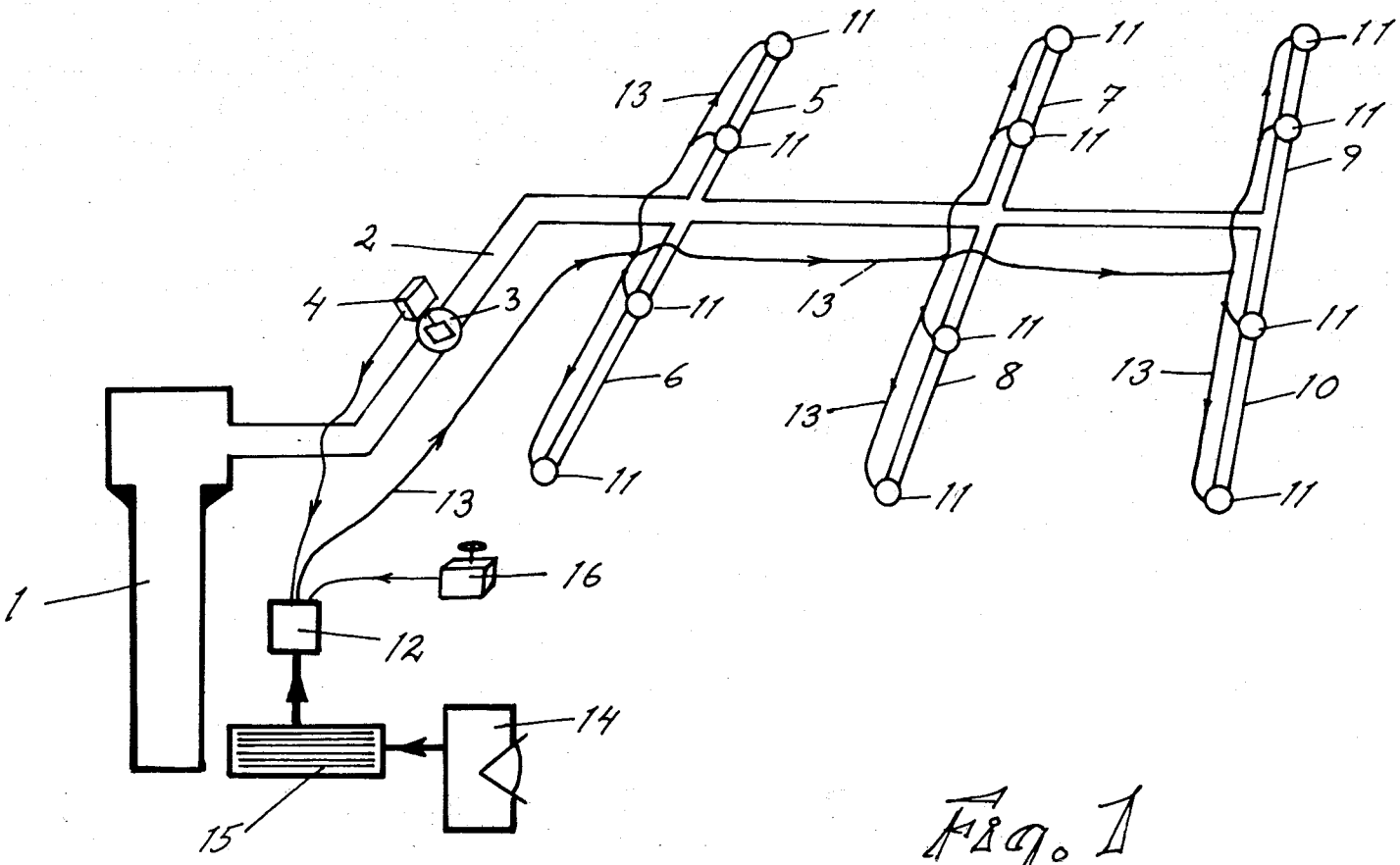
FIG. 1 is a schematic illustration of a sprinkler system embodying the invention.

The sprinkler system shown in FIG. 1 comprises a main source of water 1, a trunk water pipe 2, and a flow detector 3 connected in it, a microswitch 4 connected together with the flow detector, and distribution pipes 5–10 for distribution of the water from the trunk pipe 2 to the sprinkler heads which are designated 11. Each sprinkler head 11 is arranged with a thermal release via a glass bulb containing a highly temperature sensitive fluid and also a pyrotechnical activator arranged for electric activation by an ignition controller 12 which by means of ignition cables 13 is connected to the various sprinkler heads.

The ignition controller 12, which may comprise an ignition generator or battery ignition, can be activated by a UV sensitive detector 14 which via an amplifier 15 actuates the controller 12. This can also be activated manually via the switch 16 or by the microswitch 4 which closes as soon as water begins to flow through the trunk pipe 2. The flow detector 3 arranged according to the invention in the trunk pipe and connected with the microswitch 4 comprises a screen which is movable in the trunk pipe and which is inclined forwards in the flow direction of the water as soon as the water begins to flow through the trunk pipe, which thus takes place as soon as any one of the sprinkler heads has been activated e.g. thermally. The UV detector comprised in the system can, of course, also be complemented with a smoke sensitive detector.

Figure 2:
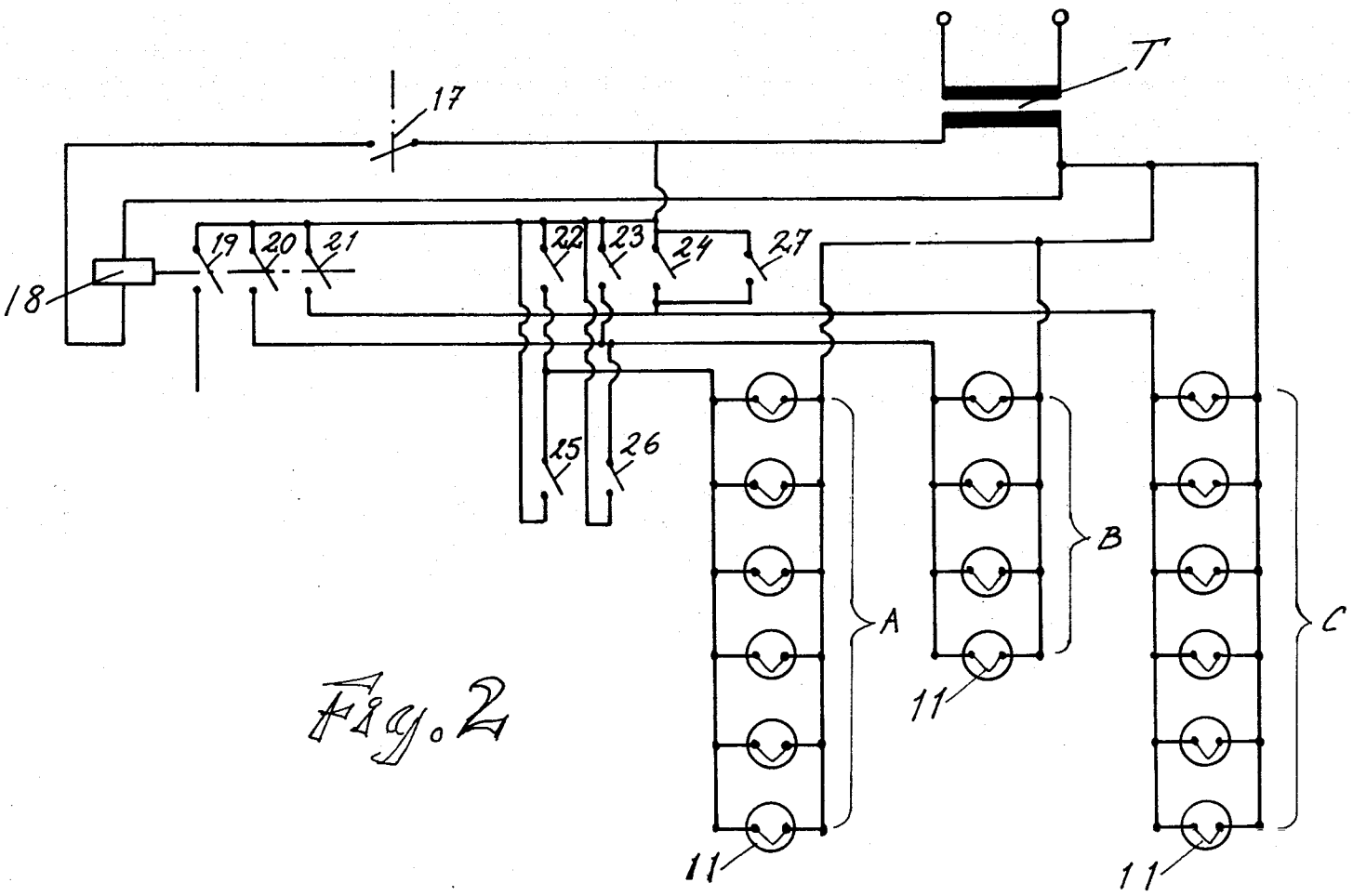
FIG. 2 is a schematic illustration of the electrical circuit used in such a system.

FIG. 2 shows a preferred interconnection of the activators 11 to permit electrical release. These activators are arranged in three groups, A, B, and C. The proposed connection circuit also comprises a transformer T, a switch 17 connected together with the UV detector according to FIG. 1, which when the UV detector is activated switches on the current direct or via an extra relay 18 which in turn closes the switches 19, 20, and 21, ignition current then being fed to the activator circuits A, B, and C. There are also switches 22, 23, and 24 for manual activation of an arbitrary circuit A-C. Finally, there are also switches 25, 26, and 27 for activation of the circuits A, B, and C, respectively. The switches 25, 26, and 27, respectively, are connected with flow detectors arranged in the trunk water pipe for the respective circuits A-C. If any of the thermal activators incorporated in the activators 11 should be released and water begins to flow through the trunk pipe to the circuit in question, all of the remaining activators in the circuit in question will thus be released.

I claim:

1. A method of releasing fire extinguishing fluid from a plurality of normally blocked sprinkler heads connected for receiving fire extinguishing fluid from a trunk conduit, comprising the steps of:

releasing a first portion of said sprinkler heads to direct said fluid at a fire;

detecting the beginning of flow of said fluid to said first portion of said sprinkler heads;

generating an electrical control signal in response to detecting said beginning of flow; and in response to said control signal, releasing a further portion of said sprinkler heads to direct said fluid at a fire.

2. A method according to claim 1, further comprising the steps of:

sensing the local temperature at each of said plurality of sprinkler heads; and releasing said first portion of said sprinkler heads in response to excess temperature sensed thereat.

3. A method according to claim 1, wherein said further portion of said sprinkler heads is released pyrotechnically in response to said control signal.

4. A method according to claim 3, further comprising the steps of:

detecting fire conditions in the vicinity of said plurality of sprinkler heads; and generating a further electrical control signal in response to detecting said fire conditions; and pyrotechnically releasing at least a portion of said sprinkler heads in response to said further electrical control signal.

5. Apparatus for extinguishing fires, comprising:

a plurality of normally blocked sprinkler heads;

a conduit network connecting said heads for receiving fire extinguishing fluid from a trunk conduit;

means for releasing a first portion of said sprinkler heads to direct said fluid at a fire;

means for detecting the beginning of flow of said fluid to said first portion of said sprinkler heads;

means for generating an electrical control signal in response to detecting said beginning of flow; and means for releasing, in response to said control signal, a further portion of said sprinkler heads to direct said fluid at a fire.

6. Apparatus according to claim 5, wherein said means for releasing a first portion comprises means located at each sprinkler head for sensing fire conditions and releasing its associated sprinkler head.

7. Apparatus according to claim 6, wherein said means for releasing a further portion is pyrotechnically actuated in response to said control signal.

8. Apparatus according to claim 6, wherein said means for sensing fire conditions is temperature sensitive and comprises a glass bulb filled with temperature sensitive fluid, the glass bulb breaking at high temperature to release said fluid.

9. Apparatus according to claim 7, further comprising means for generating a further electrical control signal in response to fire conditions in the vicinity of said plurality of sprinkler heads, said means for releasing a further portion also being responsive to said further electrical signal.

10. Apparatus according to claim 5, wherein said means for releasing a first portion comprises means for manually releasing one or more portions of said plurality of sprinkler heads.

* * * * *